United States Patent [19]

Ohno et al.

[11] Patent Number: 4,923,638

[45] Date of Patent: May 8, 1990

[54] NEAR INFRARED ABSORBING COMPOSITION

[75] Inventors: Shigeru Ohno; Yuji Mihara; Keiichi Adachi; Toshinao Ukai; Gouichi Hayashi, all of Kanagawa, Japan

[73] Assignee: Fuji Photo Film Co., Ltd., Kanagawa, Japan

[21] Appl. No.: 331,075

[22] Filed: Mar. 28, 1989

Related U.S. Application Data

[63] Continuation of Ser. No. 913,278, Sep. 30, 1986, abandoned.

[30] Foreign Application Priority Data

Sep. 30, 1985 [JP] Japan ..... 60-217315
Feb. 12, 1986 [JP] Japan ..... 61-28711

[51] Int. Cl.[5] ..... F15V 9/04

[52] U.S. Cl. ..... 252/587; 430/345; 350/354; 564/123

[58] Field of Search ..... 252/582, 586, 587; 430/345; 350/354; 564/123

[56] References Cited

U.S. PATENT DOCUMENTS

| | | | |
|---|---|---|---|
| 3,806,462 | 4/1974 | Bloom | 252/587 |
| 3,843,370 | 10/1974 | Waxman et al. | 430/511 |
| 4,042,394 | 8/1977 | Smith, Jr. et al. | 428/207 X |
| 4,307,165 | 12/1981 | Blazey et al. | 430/8 |
| 4,386,145 | 5/1983 | Gilmour | 430/7 |
| 4,508,655 | 4/1985 | Sasagawa et al. | 556/136 |

FOREIGN PATENT DOCUMENTS

| | | | |
|---|---|---|---|
| 91326 | 10/1983 | European Pat. Off. . | |
| 3520227 | 12/1985 | Fed. Rep. of Germany . | |
| 139270 | 12/1979 | German Democratic Rep. . | |
| 100116 | 8/1975 | Japan . | |
| 21458 | 2/1982 | Japan | 252/587 |
| 1011704 | 1/1986 | Japan | 252/587 |
| 1042585 | 3/1986 | Japan . | |
| 1057674 | 3/1986 | Japan . | |
| 1070503 | 4/1986 | Japan . | |
| 1496506 | 12/1977 | United Kingdom . | |

*Primary Examiner*—Mary C. Lee
*Assistant Examiner*—Catherine S. Kilby Scalzo
*Attorney, Agent, or Firm*—Sughrue, Mion, Zinn, Macpeak & Seas

[57] ABSTRACT

A near infrared absorbing composition is disclosed, containing at least one compound represented by general formula (I), having its absorption maxima at wavelengths of 720 nm or more:

(I)

wherein $R^1$ represents a substituted or unsubstituted alkyl group, a substituted or unsubstituted aryl group or a substituted or unsubstituted heterocyclic group; $R^2$ and $R^5$, which may be the same or different, each represents a hydrogen atom or a group capable of substituting a hydrogen atom; $R^3$ and $R^4$, which may be the same or different, each represents a hydrogen atom, a halogen atom, a substituted or unsubstituted alkoxy group or a substituted or unsubstituted alkyl group with the proviso that they do not simultaneously represent hydrogen atoms; and $R^6$ and $R^7$, which may be the same or different, each represents a substituted or unsubstituted alkyl group, a substituted or unsubstituted aryl group, an acyl group or a sulfonyl group, or $R^6$ and $R^7$ may be taken together to form a 5- or 6-membered ring.

10 Claims, 1 Drawing Sheet

NEAR INFRARED ABSORBING COMPOSITION

This is a continuation of application Ser. No. 913,278 filed 9/30/86.

FIELD OF THE INVENTION

The present invention relates to a near infrared absorbing composition which absorbs near infrared rays. More particularly, it relates to a near infrared absorbing composition which absorbs near infrared ray having a wavelength not less than 720 nm and is useful as an optical filter, a recording layer utilizing near infrared ray as a light source, and the like.

BACKGROUND OF THE INVENTION

A composition which selectively absorbs far infrared rays to near infrared rays having wavelengths of 720 nm or more is expected to be applied to various fields and has been keenly demanded, but a proper infrared absorbing composition has not yet been obtained. Examples of uses of the conventional infrared absorbing composition are described below.

(1) Safelight Filters for Infrared-Sensitive Materials

A number of silver halide light-sensitive materials having sensitivity to the far infrared to near infrared region having wavelengths of 700 nm or more have recently been developed. These light-sensitive materials are obtained by imparting infrared sensitivity to silver halide light-sensitive materials, whether for black-and-white photography or for color photography, inclusive of not only the conventional type but the instant type and heat development type. These light-sensitive materials are used as pseudo color films for use in exploration of resources, etc., or they are used for exposure with a semiconductor laser or a diode which emits light of the infrared region.

Safelight filters suitable for these light-sensitive materials have not hitherto been developed. Therefore, there has been a need to develop safelight filters that absorb light of the near infrared region and substantially transmit light of the visible region.

(2) Plant Growth Control

It has hitherto been known that the so-called morphosis concerning growth and differentiation of plants, such as germination, of seeds, growth of stems, foliation, formation of flower buds or tubers, etc., are influenced by light, and these photomorphogenic effects have been receiving study.

In this connection, plastic films that selectively absorb light having wavelengths of 700 nm or more are expected to be effective on growth control, for example, retardation of earing by covering a crop with a near infrared-absorbing film in a specific stage to shield light having wavelengths of 700 nm or more. Reference can be made to it in Katsumi Inada, *Shokubutsu no Kagaku Chosetsu* (*Chemical Regulation of Plant*), Vol. 6, No. 1 (1971).

(3) Heat Radiation Shields

Solar radiation energy in the near infrared and infrared regions is transformed into heat energy upon absorption into an object. Moreover, most of its energy distribution is concentrated in the near infrared region having wavelengths between 800 nm and 2,000 nm. Therefore, films that selectively absorb near infrared rays are extremely effective for shielding solar heat to thereby inhibit an increase of the room temperature while sufficiently admitting the visible light. Such films are applicable to horticultural greenhouses as well as windows of houses, offices, stores, automobiles, airplanes, etc. In these applications, the property of transmitting visible rays is very important.

Conventionally employed heat radiation shields include plastic films on which a very thin metal layer is deposited and glass having dispersed therein an inorganic compound, such as FeO.

(4) Infrared Cut Filters for Protection of Human Eyes from Infrared Rays

Infrared rays contained in sunlight or rays emitted during welding are injurious to human eye tissues. One of the chief applications of infrared cut filters is use as glasses for protecting human eyes from light rays containing injurious infrared rays, for example, as sun glasses and protectors for welding operators. In such an application, also, the property of substantially transmitting the visible light is a very important factor.

(5) Infrared Cut Filters for Semiconductor Photoreceptors

In automatic exposure meters of cameras, etc., a silicone photodiode (SPD) is currently employed as a photoreceptor of a light sensor. In the use of SPD for an exposure meter, it is necessary to cut the light in the infrared region that is not perceived by human eye to thereby make the spectral sensitivity curve of SPD similar to the relative luminosity curve. In particular, the output of SPD is large in response to rays having wavelengths of from 700 to 1,100, and also light in this region is not perceived by human eye, thus causing, in part, errors in functioning of an exposure meter. It is, therefore, apparent that use of an infrared-absorbing plastic film capable of absorbing infrared radiation over an entire region of from 700 nm to 1,100 nm with less absorption in the visible region would markedly improve performances of an exposure meter because of increased light transmittance in the visible region and the so increased output of SPD.

In the conventionally employed light sensors of this type, a glass-made infrared cut filter using an inorganic infrared absorbing agent is fitted in front of SPD.

(6) Laser Recording Layer

An infrared absorbing composition is useful as a recording layer on which recording is effected with a laser beam utilizing its property of transforming absorbed infrared rays into heat energy, such as a recording layer of photodiscs and heat-sensitive recording materials using a laser beam as a light source. Illustrative examples of such a recording layer are described in Japanese Patent Application (OPI) Nos. 214162/83, 217391/83 and 125246/83 (the term "OPI" as used herein refers to a "published unexamined Japanese patent application").

(7) Inks for Ink Jet Printers

Inks for ink jet printers comprise an organic solvent, e.g., ethyl cellosolve, and an organic solvent-soluble dye as an infrared absorbing agent. The ink-printed image is read out by means of an optical reading device using a light source emitting infrared rays having a wavelength of from 740 to 900 nm. The infrared absorbing agents which have conventionally been employed for such inks include the compounds disclosed in Japanese Patent Application (OPI) No. 135568/81, such as nigrosine, chromium complex salts, etc.

(8) Inks for Bar Code (9) Antihalation Layer of Light-Sensitive Materials

(10) Infrared Couplers Forming Infrared Absorbing Dyes for Sound Track

As described above, organic dyes have been employed as infrared absorbing agents in general applications. However, these organic dye type infrared absorbing agents have unstable absorption characteristics in the longer wavelength region and are inferior in resistance to light and heat. Therefore, there are few organic dyes which are satisfactory in practical use as infrared absorbing agents.

Although the complexes used as infrared absorbing agents exhibit satisfactory resistance to light and heat, they lack solubility in organic solvents, which forms a great problem in the production of thin plastic films.

In some detail, in the above-described uses, for example, as filters for SPD, very thin films having a high infrared absorption efficiency are desired. To this effect, a large amount of an infrared absorbing agent should be dispersed in a resin matrix. However, this cannot be achieved with infrared absorbing agents having small solubility in organic solvents.

SUMMARY OF THE INVENTION

Accordingly, an object of this invention is to provide a near infrared absorbing composition having high solubility in organic solvents.

Another object of this invention is to provide a near infrared absorbing composition having high solubility in organic solvents and satisfactory compatibility with plastic films.

A further object of this invention is to provide a near infrared absorbing composition having high solubility in organic solvents and satisfactory compatibility with film-forming binders.

As a result of extensive and intensive studies, it has now been found that the above-described objects can be accomplished by a near infrared absorbing composition containing at least one compound represented by the following general formula (I) and having its absorption maxima at wavelengths of 720 nm or more:

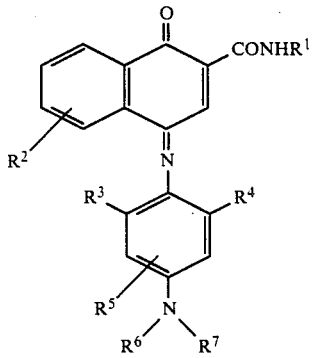

(I)

wherein $R^1$ represents a substituted or unsubstituted alkyl group, a substituted or unsubstituted aryl group or a substituted or unsubstituted heterocyclic group; $R^2$ and $R^5$, which may be the same or different, each represents a hydrogen atom or a group capable of substituting a hydrogen atom; $R^3$ and $R^4$, which may be the same or different, each represents a hydrogen atom, a halogen atom, a substituted or unsubstituted alkoxy group or a substituted or unsubstituted alkyl group, with the proviso that $R^3$ and $R^4$ do not simultaneously represent hydrogen atoms; and $R^6$ and $R^7$, which may be the same or different, each represents a substituted or unsubstituted alkyl group, a substituted or unsubstituted aryl group, an acyl group or a sulfonyl group, or $R^6$ and $R^7$ may be taken together to form a 5- or 6-membered ring.

DETAILED DESCRIPTION OF THE INVENTION

Figure 1:
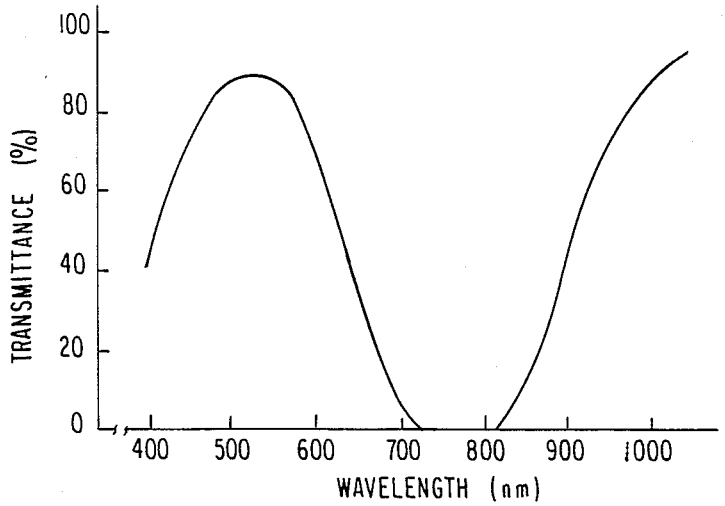
FIGS. 1 and 2 show a relationship between wavelength and percent transmittance of the optical filter obtained in Examples 1 and 2, respectively.

The compounds represented by the above-described general formula (I) include dimers formed at any of the groups represented by $R^1$, $R^2$, $R^3$, $R^4$, $R^5$, $R^6$ and $R^7$.

In general formula (I), the alkyl groups as represented by $R^1$, $R^6$ and $R^7$, which may be the same or different, each preferably contains from 1 to 18 carbon atoms, specifically including a methyl group, an ethyl group, a propyl group, an isobutyl group, an n-octyl group, an n-dodecyl group, an n-octadecyl group, etc. Substituents for the alkyl group include a cyano group, a hydroxyl group, an alkoxy group (e.g., a methoxy group, an ethoxy group, etc.), an aryloxy group (e.g., a phenoxy group, etc.), an amido group (e.g., an acetamido group, a methanesulfonamido group, etc.), a halogen atom (e.g., a chlorine atom, a fluorine atom, etc.), and the like.

The aryl groups as represented by $R^1$, $R^6$ and $R^7$, which may be the same or different, each preferably includes a substituted or unsubstituted phenyl group and a substituted or unsubstituted naphthyl group. Substituents therefor include a hydroxyl group, a cyano group, a halogen atom (e.g., a chlorine atom, a fluorine atom, etc.), an acyl group having from 2 to 18 carbon atoms (e.g., an acetyl group, a propionyl group, a stearoyl group, etc.), a sulfonyl group having from 2 to 18 carbon atoms (e.g., a methanesulfonyl group, an ethanesulfonyl group, an octanesulfonyl group, etc.), a carbamoyl group having from 1 to 18 carbon atoms (e.g., an unsubstituted carbamoyl groups, a methylcarbamoyl group, an octylcarbamoyl group, etc.), a sulfamoyl group having from 1 to 18 carbon atoms (e.g., an unsubstituted sulfamoyl group, a methylsulfamoyl group, a butylsulfamoyl group, etc.), an alkoxycarbonyl group having from 2 to 18 carbon atoms (e.g., a methoxycarbonyl group, a trichloroethoxycarbonyl group, a decyloxycarbonyl group, etc.), an alkoxy group having from 1 to 18 carbon atoms (e.g., a methoxy group, a butoxy group, a pentadecyloxy group, etc.), an amino group (e.g., a dimethylamino group, a diethylamino group, a dihexylamino group, etc.), etc.

The substituted or unsubstituted heterocyclic group as represented by $R^1$ include both monocyclic and condensed hetero rings and preferably include a 1,3-thiazole ring, a 1,3,4-triazole ring, a benzothiazole ring, a benzimidazole ring, a benzoxazole ring, a 1,3,4-thiadiazole ring, etc. The substituents therefor include an alkyl group (e.g., a methyl group, an ethyl group, an octyl group, etc.), an alkoxy group (e.g, a methoxy group, an ethoxy group, a decyloxy group, etc.), a hydroxyl group, etc.

The group capable of substituting a hydrogen atom as represented by $R^2$ or $R^5$ includes a halogen atom (e.g., a fluorine atom, a chlorine atom, a bromine atom, etc.), a hydroxyl group, a cyano group and a substituted or unsubstituted alkyl group having from 1 to 18 carbon atoms (e.g., a methyl group, an ethyl group, a butyl group, a 2-ethylhexyl group, a stearyl group, etc.) which is bonded to the benzene ring either directly or via a divalent linking group, wherein the divalent linking group includes —O—, —NHCO—, —$NHSO_2$—, —NHCOO—, —NHCONH—, —COO—, —CO—, —$SO_2$—, —NR—, etc., wherein R represents a hydrogen atom or a substituted or unsubstituted alkyl group having from 1 to 18 carbon atoms.

The halogen atom as represented by $R^3$ or $R^4$ includes a chlorine atom, a bromine atom, etc. The alkoxy group as represented by $R^3$ or $R^4$ contains from 1 to 18 carbon atoms and specifically includes a methoxy group, an ethoxy group, an octoxy group, and the like. The alkyl group as represented by $R^3$ or $R^4$ contains 1 to 18 carbon atoms and includes a methyl group, an ethyl group, a butyl group, a 2-ethylhexyl group, a stearyl group, and the like.

Examples of the acyl group as represented by $R^6$ or $R^7$ include an acetyl group, a propionyl group, etc. The sulfonyl group as represented by $R^6$ or $R^7$ includes a methanesulfonyl group, an ethanesulfonyl group, etc. The 5- or 6-membered ring as jointly represented by $R^6$ and $R^7$ includes a pyrrolidine ring, a piperidine ring, a morpholine ring, etc.

$R^1$ preferably represents a substituted or unsubstituted heterocyclic ring or a phenyl group substituted with a monovalent group having a Hammett's substituent constant $\delta_m$ or $\delta_p$ of not smaller than 0.23. Preferred examples of such a substituent include a halogen atom (e.g., a fluorine atom, a chlorine atom, a bromine atom, etc.), a cyano group, a formyl group, a carboxyl group, a carbamoyl group (e.g., an unsubstituted carbamoyl group, a methylcarbamoyl group, etc.), an alkoxycarbonyl group (e.g., a methoxycarbonyl group, an ethoxycarbonyl group, etc.), an acyl group (e.g., an acetyl group, a benzoyl group, etc.), a nitro group, a sulfamoyl group (e.g., an unsubstituted sulfamoyl group, a metnylsulfamoyl group, etc.), a sulfonyl group (e.g., a methanesulfonyl group, a benzenesulfonyl group, etc.), etc. The Hammett's $\delta_m$ and $\delta_p$ values are described in *Yakubutsu no Kozo Kassei Sokan* (*Structural Activity Correlation of Drugs*), p. 96, Nanko-do (1979), and the substituent for a phenyl group can be selected according to the table described therein.

$R^3$ and $R^4$ each preferably represents an alkyl group having from 1 to 5 carbon atoms, such as a methyl group, an ethyl group, etc.

Specific examples of the compounds represented by general formula (I) are shown below, but they are not intended to limit the present invention.

(I-1)

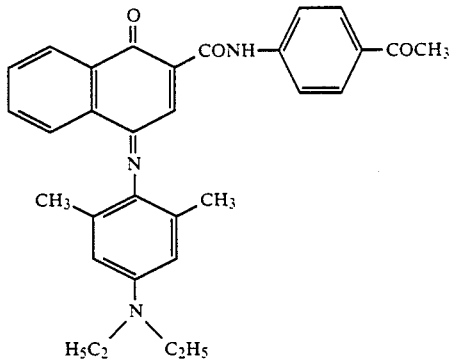

(I-2)

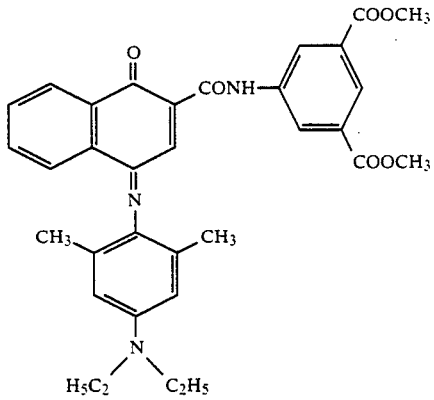

(I-3)

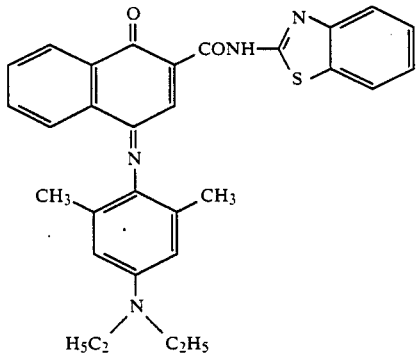

(I-4)

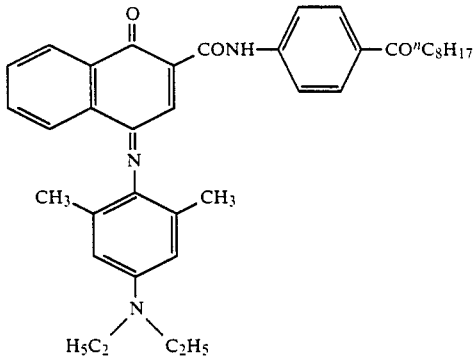

-continued
(I-5)
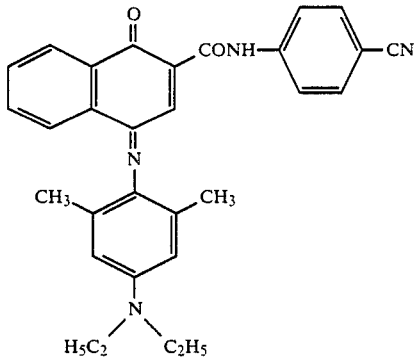
(I-6)
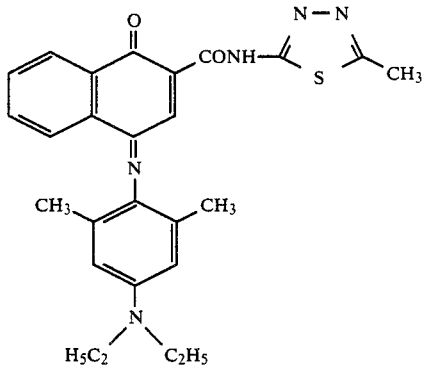
(I-7)
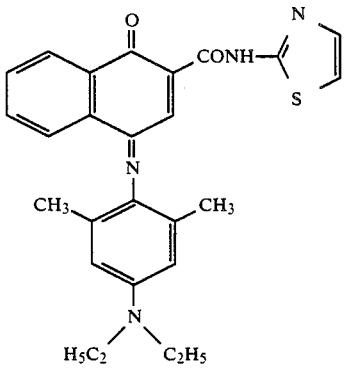
(I-8)
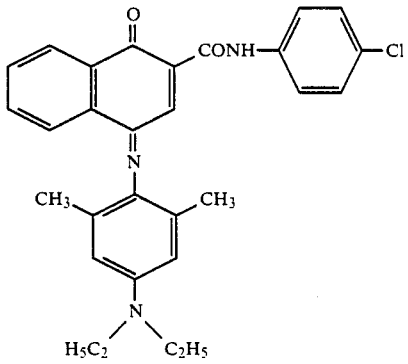
-continued
(I-9)
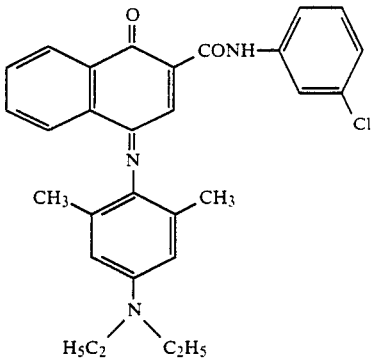
(I-10)
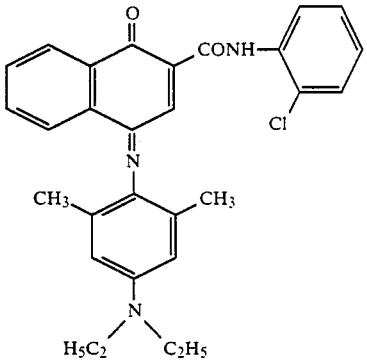
(I-11)
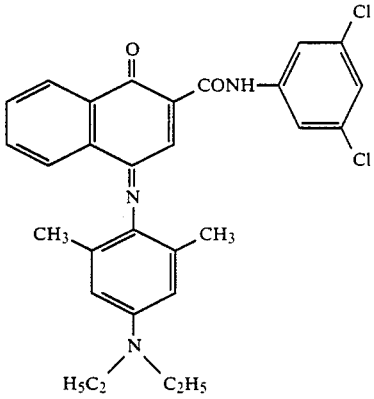
(I-12)
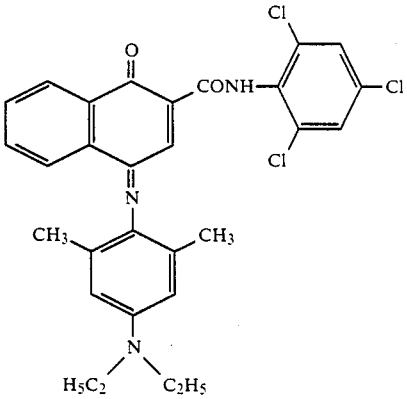

-continued
(I-13)
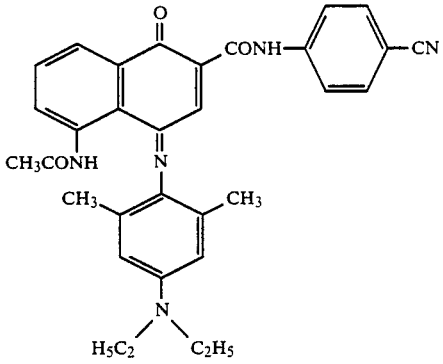
(I-14)
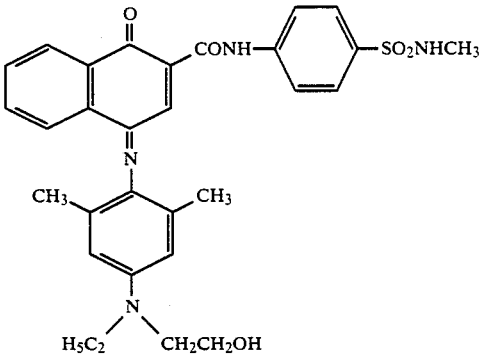
(I-15)
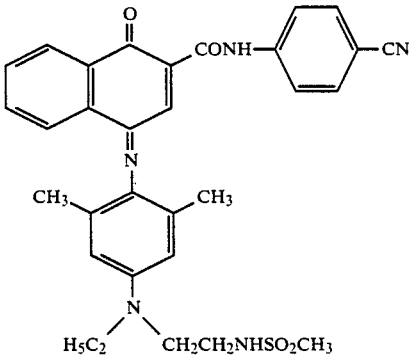
(I-16)
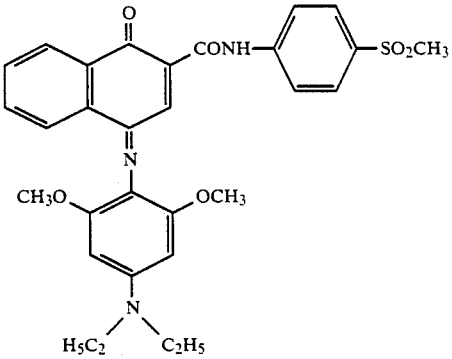
-continued
(I-17)
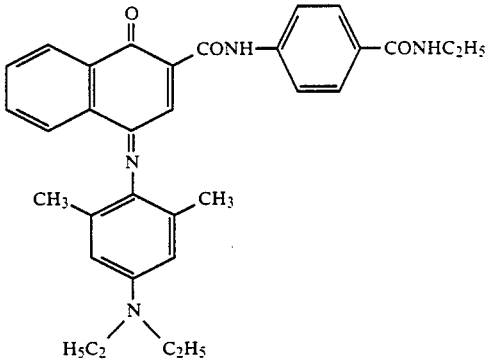
(I-18)
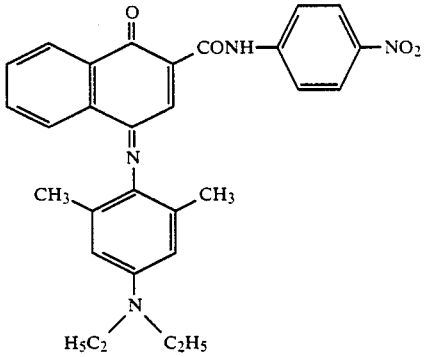
(I-19)
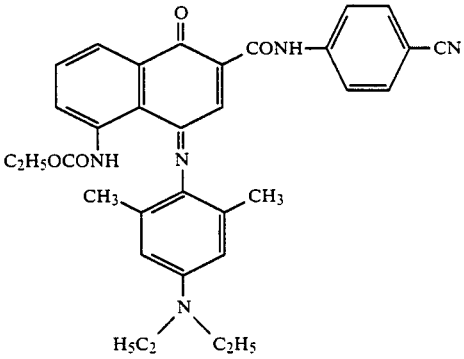
(I-20)
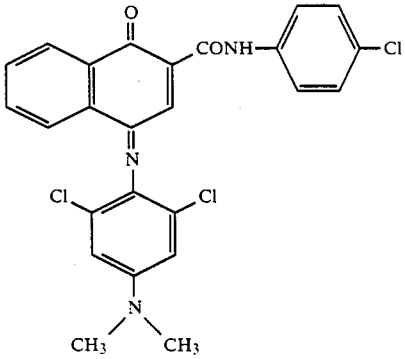

-continued
(I-21)
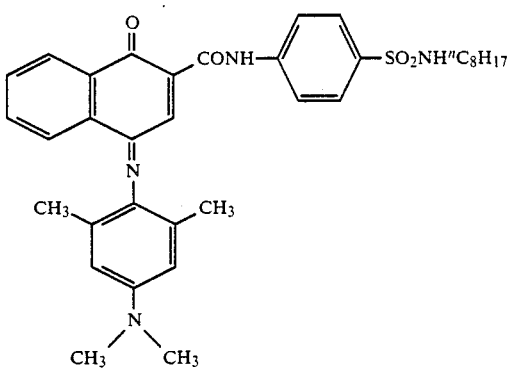
(I-22)
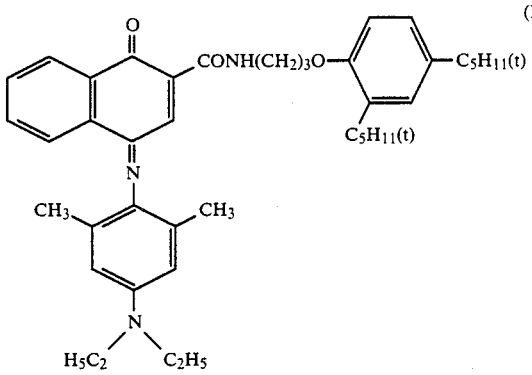
(I-23)
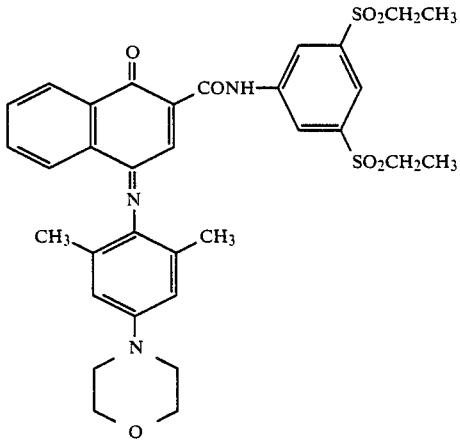
(I-24)
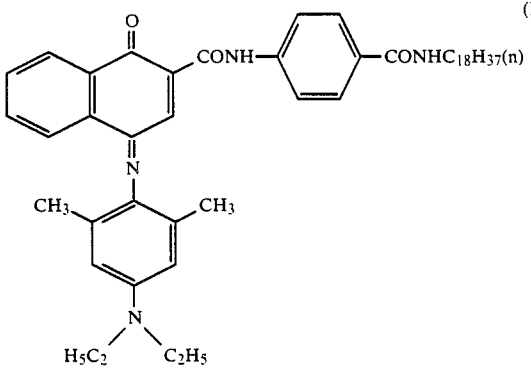
-continued
(I-25)
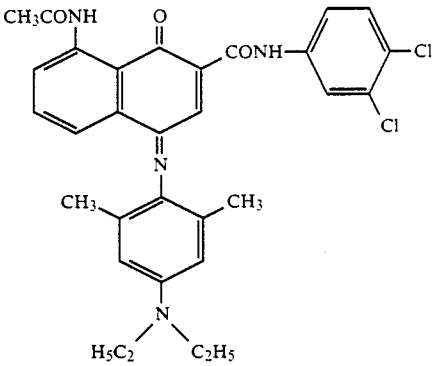
(I-26)
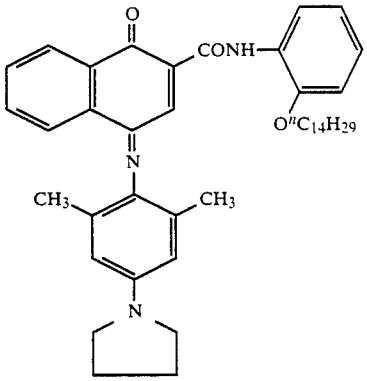
(I-27)
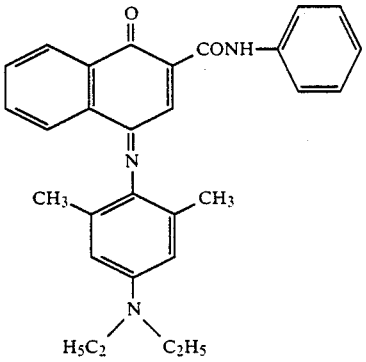
(I-28)
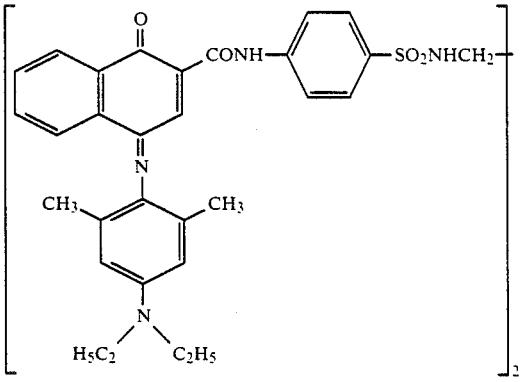

-continued (I-29)

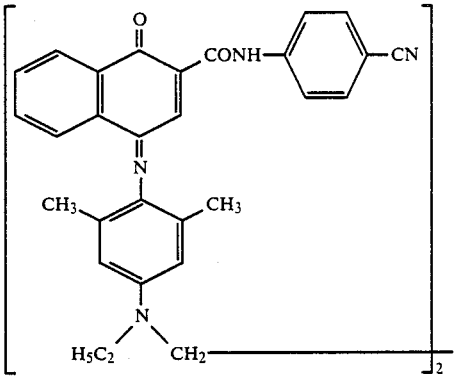

(I-30)

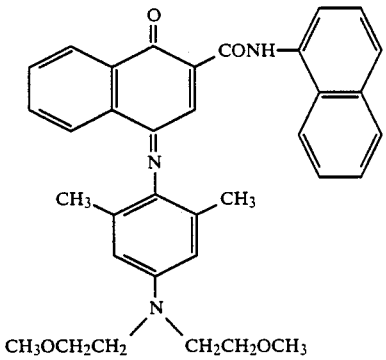

(I-31)

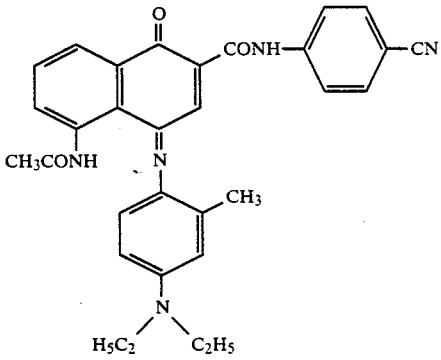

(I-32)

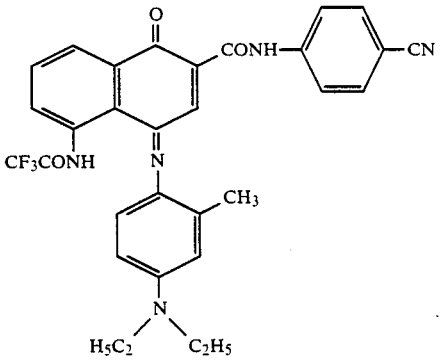

-continued (I-33)

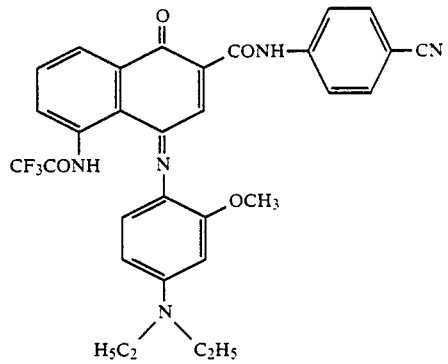

(I-34)

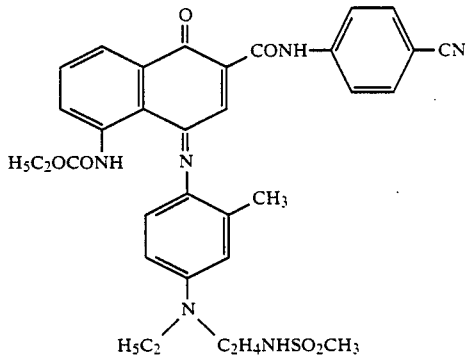

(I-35)

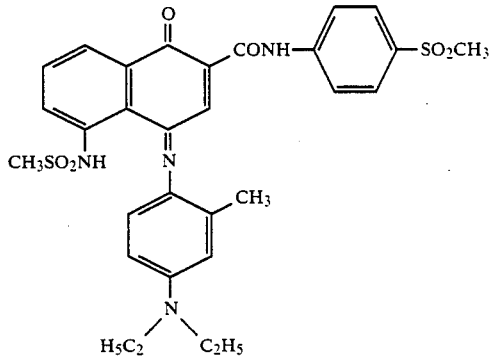

The compounds represented by general formula (I) can be synthesized by a process of condensation of a dialkylaniline and a 4-nitrosonaphthol in concentrated sulfuric acid, a process of condensation of an α-naphthol and a p-phenylenediamine in the copresence of a base and an oxidizing agent, a process of oxidative condensation of a 4-amino-1-naphthol and a dialkylaniline in a sodium hypochlorite solution, a process of condensation of a p-nitrosodialkylaniline and an α-naphthol, and the like, as disclosed, e.g., in Japanese Patent Application (OPI) Nos. 100116/75 and 32851/85, S. Fujita, *Journal of Organic Chemistry,* 48, 177–183 (1983), etc.

Examples of the synthesis of the compounds represented by general formula (I) are described below:

SYNTHESIS EXAMPLE 1

Synthesis of Compound (I-1)

To a mixture of 9.2 g of 2-(4-acetylphenylcarbamoyl)-1-naphthol, 75 ml of ethanol and 150 ml of ethyl acetate were added 210 ml of an aqueous solution containing 21 g of sodium carbonate, and 6.9 g of 4-diethylamino-2,6-dimethylaniline. To the resulting mixture was further added dropwise 70 ml of an aqueous solution containing 16.4 g of ammonium persulfate over a period of 30 minutes while stirring. After the dropwise addition, the stirring was continued for an additional 2 hours. The reaction mixture was allowed to stand, and the ethyl acetate phase was taken out, washed with water and concentrated. The concentrate was recrystallized from chloroform to obtain 4.1 g of Compound (I-1) as greenish blue crystals having a melting point of 219° to 220° C.

$\lambda_{max}^{CHCl_3} = 768$ nm ($\epsilon = 1.73 \times 10^4$)

SYNTHESIS EXAMPLE 2

Compounds shown in Table 1 were synthesized in the same manner as described in Synthesis Example 1 but using α-naphthols and p-phenylenediamines shown in Table 1. The results obtained are also shown in Table 1.

TABLE 1

| Compound | α-Naphthol | p-Phenylenediamine | Melting Point (°C.) | $CHCl_3$ $\lambda_{max}$ (nm) | $\epsilon$ ($\times 10^{-4}$) |
|---|---|---|---|---|---|
| (I-2) | 2-(3,5-Dimethoxycarbonyl)-1-naphthol | 4-Diethylamino-2,6-dimethylaniline | 203–204 | 766 | 1.65 |
| (I-3) | 2-(2-Benzothiazolylcarbamoyl)-1-naphthol | 4-Diethylamino-2,6-dimethylaniline | 233–224 | 780 | 2.00 |
| (I-5) | 2-(4-Cyanophenylcarbamoyl)-1-naphthol | 4-Diethylamino-2,6-dimethylaniline | 209–210 | 773 | 1.84 |
| (I-7) | 2-(2-Thiazolylcarbamoyl)-1-naphthol | 4-Diethylamino-2,6-dimethylaniline | 209–211 | 774 | 1.75 |
| (I-8) | 2-(4-Chlorophenylcarbamoyl)-1-naphthol | 4-Diethylamino-2,6-dimethylaniline | 218–219 | 762 | 1.63 |
| (I-10) | 2-(2-Chlorophenylcarbamoyl)-1-naphthol | 4-Diethylamino-2,6-dimethylaniline | 213–214 | 756 | 1.52 |
| (I-11) | 2-(3,5-Dichlorophenylcarbamoyl)-1-naphthol | 4-Diethylamino-2,6-dimethylaniline | 226–227 | 770 | 1.76 |
| (I-13) | 5-Acetylamino-2-(4-cyanophenylcarbamoyl)-1-naphthol | 4-Diethylamino-2,6-dimethylaniline | 191–193 | 780 | 1.53 |
| (I-18) | 2-(4-Nitrophenylcarbamoyl)-1-naphthol | 4-Diethylamino-2,6-dimethylaniline | 213–214 | 776 | 1.87 |
| (I-27) | 2-Phenylcarbamoyl-1-naphthol | 4-Diethylamino-2,6-dimethylaniline | 207–209 | 758 | 131 |

When the near infrared absorbing composition of the present invention is used as an optical filter, the compound represented by general formula (I) can be used by being incorporated in an appropriate binder. Binders to be used may be either organic or inorganic as long as they do not interfere with the absorption of infrared rays, and include high molecular weight materials, such as plastics, and inorganic materials, such as glass.

It is preferable to use binders excellent in transparency and mechanical properties, such as polyesters, e.g., polyethylene terephthalate, etc.; cellulose esters, e.g., cellulose diacetate, cellulose triacetate, cellulose acetate butyrate, etc.; polyolefins, e.g., polyethylene, polypropylene, etc.; polyvinyl compounds, e.g., polyvinyl chloride, polyvinylidene chloride, vinyl chloride-vinyl acetate copolymers, polystyrene, etc.; acrylic addition polymers, e.g., polymethyl methacrylate, etc.; polycarbonates composed of polycarbonic acid esters; urethane resins; hydrophilic binders, e.g., gelatin, etc.; and other known film-forming binders.

Among these binders, cellulose esters, e.g., cellulose triacetate, etc., are more preferred in view of their excellent transparency and mechanical properties.

Methods of forming a film from the near infrared absorbing composition of the present invention include the following four methods. The first method comprises incorporating the compound of general formula (I) into the above-described plastics at the time of film formation. That is, the compound of general formula (I) and various additives are mixed with polymer powders or pellets and melt-extruded by T-die extrusion or blown-film extrusion or calendered to obtain a film having uniformly dispersed therein the compound of general formula (I). In the case of film casting, the compound of general formula (I) is incorporated into a polymer solution to be flow-casted.

The second film formation method comprises coating a polymer solution or dispersion containing the compound of general formula (I) on a plastic film of various kinds prepared by an appropriate process or a glass plate to thereby form a near infrared absorber coating. The binder to be used for the coating composition is selected from those capable of dissolving the compound of general formula (I) as well as possible and also exhibiting excellent adhesion to a plastic film or a glass plate used as a support. Examples of binders which meet this purpose are polymethyl methacrylate, cellulose acetate butyrate, polycarbonate, etc. In order to ensure adhesion between the support and the coating, an undercoat may be coated previously on the surface of the support.

The third film forming method comprises mixing the compound of general formula (I) and a polymerizable monomer in a window frame for incident light of a device which should be shielded from infrared rays, adding an appropriate polymerization initiator to the mixture, and applying heat or light to the mixture to cause polymerization, thereby forming a polymer filter over the window frame. According to this method, it is possible to entirely cover the whole device with plastics prepared from an ethylenically unsaturated polymerizable monomer or an addition-polymerizable composition, such as an epoxy resin.

The fourth film forming method comprises vacuum-evaporating the compound of general formula (I) onto an appropriate support. In this case, a protective layer comprising an appropriate film forming binder may be provided on the deposited film.

The optical filters obtained from the near infrared absorbing composition according to the present invention may be used in combination with color separation filters as described in Japanese Patent Application (OPI) Nos. 58107/82, 9317/84 and 30509/84.

In the production of optical filters from the near infrared absorbing composition of the present invention, the compounds represented by general formula (I) may be used either individually or in combination of two or more thereof.

It is particularly preferable that the near infrared absorbing composition of the present invention further contains a compound represented by the following general formula (II) in order to ensure broadening of the absorption wavelength region:

(II)

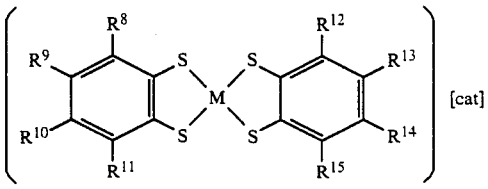

wherein $R^8$, $R^9$, $R^{10}$, $R^{11}$, $R^{12}$, $R^{13}$, $R^{14}$ and $R^{15}$ each represents a hydrogen atom, a halogen atom (e.g., a chlorine atom, a bromine atom, etc.) or a substituted or unsubstituted alkyl group (e.g., a methyl group, an ethyl group, a propyl group, an n-octyl group, etc., each of them may be substituted with a halogen atom such as a chlorine atom, and a lower alkoxy group such as a methoxy group or an ethoxy group) which is bonded to the benzene ring either directly or via a divalent linking group (e.g., —O—, —NHCO—, —CO—, —COO—, —$SO_2$—, —NHCOO—, —NHCONH—, —$NHSO_2$—, etc.); M represents nickel, cobalt, copper, palladium or platinum, and preferably nickel; and "cat" represents a cation (e.g., sodium, potassium, ammonium, quaternary ammonium, quaternary phosphonium, etc.), preferably a quaternary ammonium represented by

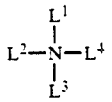

or a quaternary phosphonium represented by

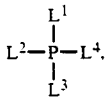

and more preferably a quaternary phosphonium; wherein $L^1$, $L^2$, $L^3$ and $L^4$, each represents a substituted or unsubstituted alkyl group having from 1 to 20 carbon atoms (e.g., a methyl group, an ethyl group, an n-butyl group, an n-dodecyl group, an n-octadecyl group, etc., which may be substituted with a hydroxyl group, a cyano group, a halogen atom such as a chlorine atom or a fluorine atom, or an alkoxyl group such as a methoxy group or an ethoxy group) or a substituted or unsubstituted aryl group having from 6 to 14 carbon atoms (e.g., a phenyl group, a tolyl group, an α-naphthyl group, etc., which may be substituted with a hydroxyl group, a cyano group, a halogen atom such as a chlorine atom or a fluorine atom, or an alkoxyl group such as a methoxy group or an ethoxy group).

The added amount of the compound represented by general formula (II) to the near infrared absorbing composition of the present invention is preferably from 0.1 to 4.0 parts by weight per 1 part by weight of the compound represented by general formula (I) contained in the composition.

Preferred specific examples of the compounds represented by general formula (II) are shown below, but they are not limiting the present invention:

(II-1)

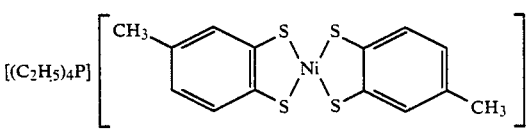

(II-2)

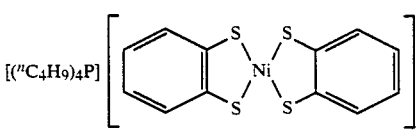

(II-3)

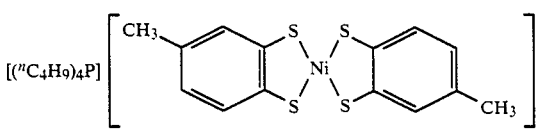

(II-4)

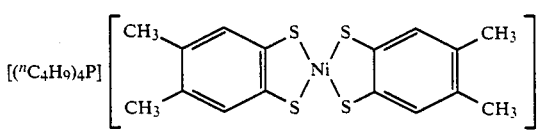

(II-5)

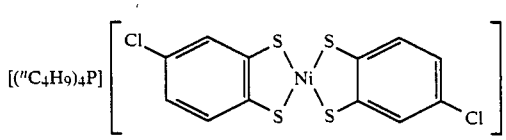

-continued
(II-6)
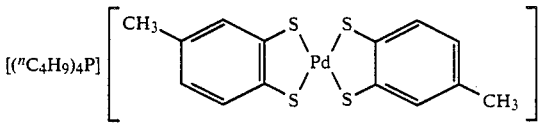
(II-7)
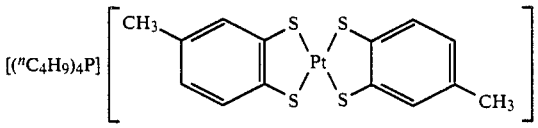
(II-8)
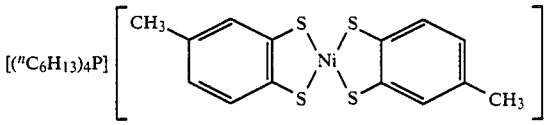
(II-9)
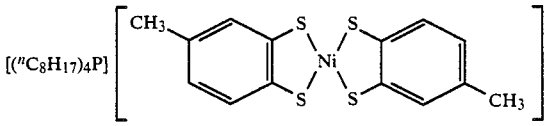
(II-10)
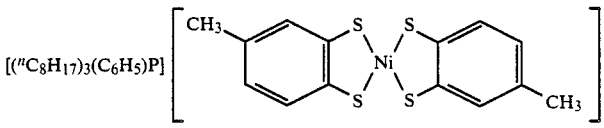
(II-11)
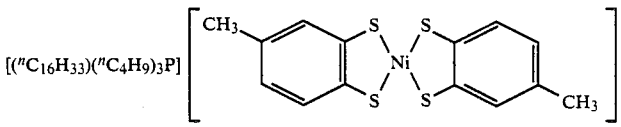
(II-12)
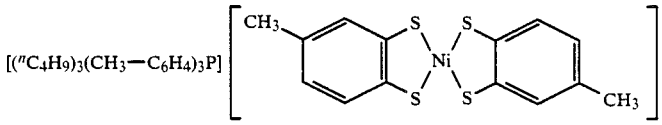
(II-13)
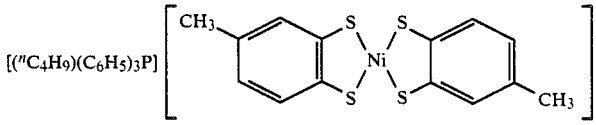
(II-14)
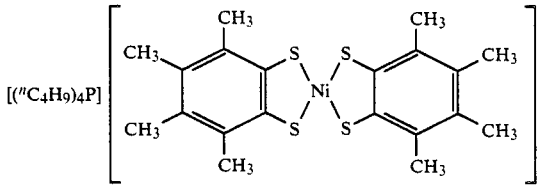
(II-15)
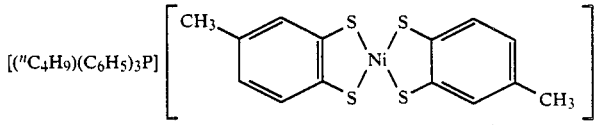

-continued (II-16)

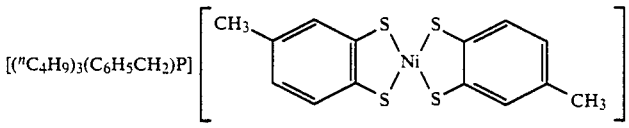

(II-17)

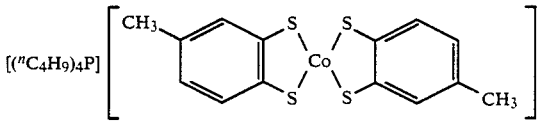

(II-18)

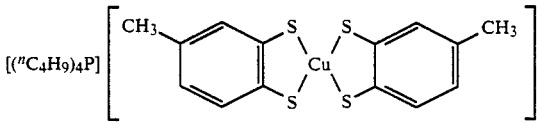

(II-19)

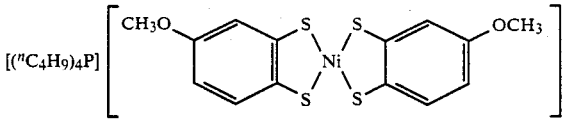

(II-20)

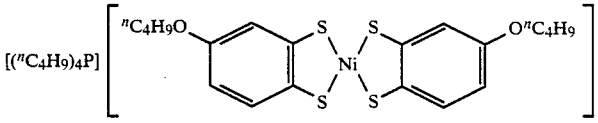

(II-21)

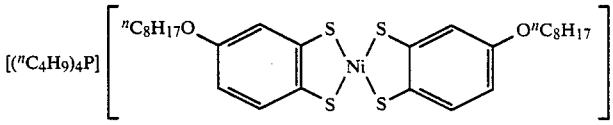

(II-22)

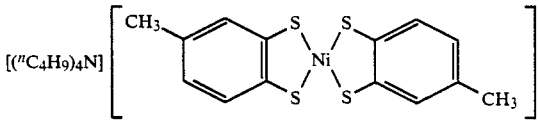

(II-23)

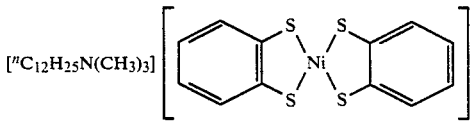

(II-24)

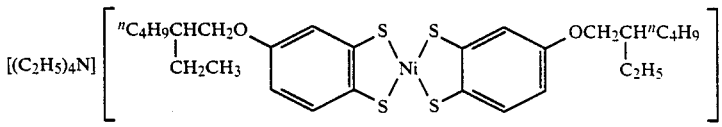

It is preferable that the near infrared absorbing composition according to the present invention, when used as an optical filter, substantially transmits light having wavelengths of from 500 to 600 nm. If desired, the composition may contain an ultraviolet ray absorbent, such as substituted or unsubstituted benzoic esters, e.g., resorcin monobenzoate, methyl salicylate, etc.; cinnamic esters, e.g., butyl 2-oxo-3-methoxycinnamate, etc.; benzophenones, e.g., 2,4-dioxybenzophenone, etc.; $\alpha,\beta$-unsaturated ketones, e.g., dibenzalacetone, etc.; coumarins, e.g., 5,7-dihydroxycoumarin, etc.; carbostyrils, e.g., 1,4-dimethyl-7-hydroxycarbostyril, etc.; azoles, e.g., 2-phenylbenzimidazole, 2-(2-hydroxyphenyl)benzotriazole, etc.; and the like. The composition of the present invention may further contain yellow dyes or cyan dyes, if desired.

In the cases where the infrared absorbing film is prepared by the coating method, a thin plastic film may be laminated or coated on the coating layer for the purpose of protecting the coating layer or imparting antifogging properties to the coating layer. For example, a laminate film can be obtained by superposing a 0.05 mm thick polyvinyl chloride film on the coating layer and pressing the laminate at a temperature of from 120° to 140° C.

The near infrared absorbing composition of the present invention, when used as an optical filter, contains the compound of general formula (I) in an amount of from 0.1 to 50 parts, and preferably from 0.5 to 10 parts, by weigh per 100 parts by weight of the binder used. It is sufficient for the optical filter obtained from the near infrared absorbing composition of the present invention to have a very low transmittance in the wavelength region to be shielded as to perform the desired function. It is important to control the amount of the binder to be added and the filter thickness so that the resulting optical filter may have a transmittance of not more than 10%, preferably not more than 2.0%, and more preferably not more than 0.1%, in the wavelength region of 720 nm or more. In addition, it is preferable that the optical filter has a transmittance of not less than 5%, preferably not less than 10%, and more preferably not less than 20%, in the wavelength region of from 500 to 600 nm. A practical thickness of the filter usually ranged from 0.002 to 0.5 mm, but filters having a thickness out of this range may also be designed according to uses.

Another embodiment of the present invention in which the near infrared absorbing composition of the present invention is applied to photorecording media utilizing a laser beam will be described below.

Photorecording media essentially comprise a base having provided thereon a recording layer. If necessary, an undercoat may be provided on the base, and a protective layer may be provided on the recording layer.

Any of the known bases can be employed as long as they are transparent to the laser to be used. Typical examples of usable bases are glass and plastics including acrylic resins, polycarbonates, polysulfones, polyimides, polyesters, etc. The base can have various shapes such as a disc, a card, a sheet, a roll film, and the like.

Guide grooves may be formed on the glass or plastic base in order to facilitate tracking on recording. The undercoat which can be provided on the glass or plastic base comprises a plastic binder, an inorganic oxide, an inorganic sulfide, etc. An undercoat having a lower thermal conductivity than that of the base is preferred.

The recording layer may have a single layer structure comprising a near infrared absorbing agent alone or in combination with other materials, or may have a two-layer structure composed of a reflective layer and a light-absorbing layer containing the above-described near infrared absorbing agent. The former, a single recording layer, can be formed by coating or vacuum-depositing a solution of the near infrared absorbing agent in a solvent on the base or coating the base with a mixture of the near infrared absorbing agent with a resin solution and/or other dyes.

The resins which can be used in the coating are conventional and include, for example, polyvinyl alcohol, polyvinyl pyrrolidone, polyvinyl butyral, polycarbonate, nitrocellulose, polyvinyl formal, methyl vinyl ether, maleic anhydride copolymers, styrenebutadiene copolymer, etc. A preferred weight ratio of the near infrared absorbing agent represented by general formula (I) to the resin in the near infrared absorbing composition is at least 0.01 and more preferably 0.1 or more. A combined use of other dyes showing absorption in the region outside the wavelength region of a semiconductor laser makes it possible to effect recording with not only a semiconductor laser but an He-Ne laser, etc. Such dyes include triarylmethane dyes, merocyanine dyes, cyanine dyes, azo dyes, anthraquinone dyes, etc.

The above-described recording layer may have a monolayer or multilayer structure.

The recording layer usually has a thickness ranging from 0.01 to 1 μm, and preferably from 0.08 to 0.8 μm. In the case of reflective readout, a particularly preferred thickness of the recording layer is odd-numbered times $\frac{1}{4}$ the wavelength of the laser used for readout.

In the case when a reflective layer for a semiconductor laser or an He-Ne laser is provided, a reflective layer is first formed on a base, and a recording layer is then formed on the reflective layer by the above-mentioned method. Alternatively, a recording layer is first formed on a base, followed by forming a reflective layer thereon.

The reflective layer can be formed by vapor deposition, sputtering, ion plating and, in addition, by a process in which a water-soluble resin (e.g., polyvinyl pyrrolidone, polyvinyl alcohol, etc.) having dissolved therein a metal salt or a metal complex salt and further incorporated therein a reducing agent is coated on a base followed by heat-drying at a temperature of from 50° to 150° C., and preferably from 60° to 100° C.

The weight ratio of the metal salt or metal complex salt to the resin is in the range of from 0.1 to 10, and preferably from 0.5 to 1.5. In this case, the reflective layer containing metal particles preferably has a thickness of from 0.01 to 0.1 μm, with the thickness of the light-absorbing layer ranging from 0.01 to 1 μm.

Examples of the metal salt or metal complex salt to be used include silver nitrate, potassium silver cyanide, potassium gold cyanide, silver-ammine complex salt, cyano-silver-complex, gold salts, cyano-gold-complex, etc. The reducing agent to be used include formalin, tartaric acid, tartaric acid salts, hypophosphites, sodium boron hydride, dimethylaminoborane, etc. The reducing agent is used in an amount of from 0.2 to 10 mols, and preferably from 0.5 to 4 mols, per mol of the metal salt or metal complex salt.

In the above-described photorecording media, recording of informations can be carried out by projecting a high energy spot beam, such as a laser beam, on the recording layer through the base or from the side opposite to the base. The absorbed light in the recording layer is transformed into heat to thereby form pits in the recording layer.

The thus recorded information can be read out by irradiating a laser beam having an output lower than the threshold energy of recording and detecting the differences in reflected light volume between the pitted areas and non-pitted areas.

A still another embodiment according to the present invention, in which the near infrared absorbing composition of the present invention is applied to ink jet inks, will be described below.

Inks for ink jet printers are mainly employed in printers of static acceleration systems, static air stream systems, etc. In any of these systems, high pressure pulses should be applied to the ink so as to form an ink stream or ink droplets. In this connection, considerations should be given not only to electrical properties of the ink but also to physical properties concerning flowability, such as surface tension, viscosity, etc. Application of high pressure pulses can be carried out by the method described, e.g., in Japanese Patent Application (OPI) Nos. 50935/74 and 135568/81.

The inks for ink jet printers can be prepared by dissolving the near infrared absorbing agent of the present invention in an organic solvent, typically exemplified by ethyl cellosolve, toluene, ethanol, n-butanol, ethyl methyl ketone, methyl isobutyl ketone, dichloromethane, triethanolamine, dimethylformamide, isoamyl acetate, etc., and adding glycerin, a metallic soap or the like to the solution for the purpose of viscosity control.

The proportion of the organic solvent and the viscosity-controlling agent should be selected so as to have a viscosity of not more than 10 cp. at room temperature and a specific resistance of from $1\times10^4$ to $1\times10^{11}$ Ω·cm.

The near infrared absorbing agent is used in an amount of from 0.01 to 0.8 part by weight per part by weight of the organic solvent. The near infrared absorbing agent should be at least finely dispersed to an average particle size not greater than 0.8 μm, and preferably should be dissolved in the solvent at room temperature. In some cases, the ink may further contain a visible ray absorbing dye.

The near infrared absorbing composition in accordance with the present invention can be used in combination with known organic or metal complex type near infrared absorbing agents. In particular, a combined use with an absorbent having a different absorption maximum serves to broaden the absorption wavelength region.

Although the compounds of the present invention exhibit sufficient light fastness even when used alone, light fastness can further be ensured by combining with metal complexes described in Japanese Patent Application (OPI) Nos. 87649/74, 62826/79, 62987/79, 65185/79, 69580/79, 72780/79, 82234/79, 82384/79, 82385/79 and 82386/79, U.S. Pat. Nos. 4,268,605 and 4,246,330, Japanese Patent Application (OPI) Nos. 12129/80 and 167138/81, and Japanese Patent Application No. 13396/86, entitled "Method of Photostabilizing Organic Substrate" filed by Fuji Photo Film Co., Ltd. on Jan. 24, 1986.

According to the present invention, a composition that absorbs near infrared rays having wavelengths of 720 or more while substantially transmitting visible rays can be obtained, which is very advantageous for producing optical filters having exellent fastness to light and heat at low cost.

Further, solubility of the near infrared absorbing composition of the present invention in solvents can be controlled by appropriately selecting the substituents of the compound of general formula (I), which advantageously allows a wide choice in binders.

The optical filters obtained from the near infrared absorbing composition of the present invention can find a wide variety of applications as near infrared absorbers, such as safelight filters for infrared-sensitive photographic materials, infrared cut filters for controlling plant growth, heat radiation shields, infrared cut filters for protection of human eye tissues, infrared cut filters for semiconductor photoreceptors or solid state color image pickup elements, infrared cut filters for optoelectronic integrated circuits in which an element having optical functions as well as electrical functions is incorporated in the same base, and so on.

The composition of the present invention can also be used in recording media utilizing lasers and inks for ink jet printers.

The composition of the present invention can further be used as an infrared radiation/heat transducer taking advantage of its property to transform absorbed near infrared rays into heat energy. Typical examples of such an application include incorporation in laser heat-sensitive recording materials as described in Japanese Patent Application (OPI) Nos. 14095/82 and 14096/82, by which the mixing color formation reaction induced by heat generated upon irradiation of an infrared laser beam can be accelerated; incorporation in resist materials whose solubility is varied by the action of heat generated by a laser beam, as described in Japanese Patent Application (OPI) No. 40256/82; and incorporation in thermodrying or thermosetting compositions as described in Japanese Patent Application (OPI) No. 143242/81, by which the thermal reaction can be accelerated.

In addition, the compounds according to the present invention can be utilized as electrophotographic photoreceptors of electrophotographic printers using a semiconductor laser as a light source, as taught in Japanese Patent Application (OPI) No. 214162/83. The compounds of the present invention can also be incorporated in a toner composition for electrophotography to thereby improve heat-fixing properties.

The foregoing description as to application of the compounds of the present invention has been given for illustrative purposes only and not for limitation.

The present invention will now be illustrated in greater detail with reference to the following examples, but it should be understood that they are not intended to limit the present invention. In these examples, all the parts are given by weight.

EXAMPLE 1

The following components were thoroughly mixed under stirring, followed by filtration to prepare a coating composition.

| | parts |
|---|---|
| Cellulose Triacetate | 170 |
| Triphenyl Phosphate | 10 |
| Methylene Chloride | 800 |
| Methanol | 160 |
| Compound (I-5) | 2 |

The coating composition was flow-casted on a metal support. After solidification, the film thus formed was peeled off to obtain an optical filter having a dry thickness of 25 μm.

The optical density of the resulting optical filter having a dry thickness of 25 μm is shown in FIG. 1. As can be seen from FIG. 1, this optical filter shows high percent transmittance in the visible region and low percent transmittance in the near infrared region.

EXAMPLE 2

A 0.15 mm thick optical filter was prepared in the same manner as described in Example 1 except that the casting composition further contained 2 parts of Compound (II-3).

Figure 2:
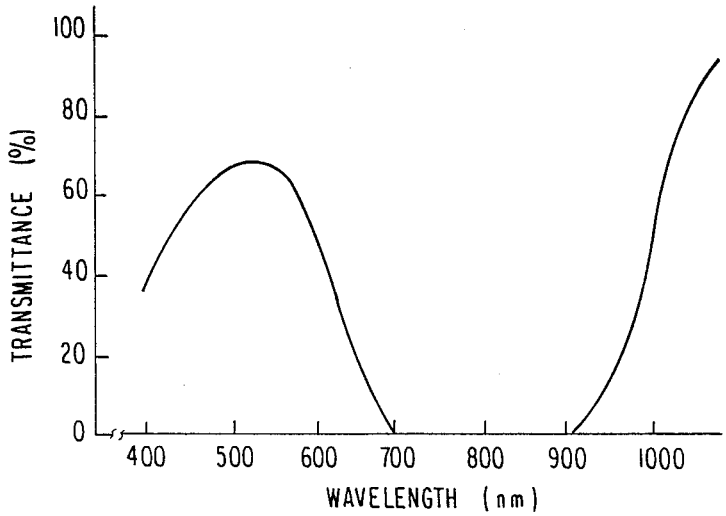

The optical density of the resulting optical filter is shown in FIG. 2. It can be seen from FIG. 2 that this optical filter has low percent transmittance in the near infrared region similarly to Example 1, with its absorption region being broadened.

EXAMPLE 3

The following components were uniformly mixed to obtain a homogeneous ink composition having a specific resistance of $10^3$ Ω·cm and a viscosity of 5 cp.

| | parts |
|---|---|
| Compound (I-5) | 0.8 |
| Oil-Soluble Blue Dye | 0.7 |
| Ethyl Cellosolve | 5 |
| 1,2-Benzisothiazolone (fungistat) | 0.001 |
| Glycerin | 3 |

The ink composition was charged in an ink jet recording device to obtain a satisfactory image, which could be read out by a reading device using a semiconductor laser beam (780 nm) as a light source.

| | parts |
|---|---|
| Isoamyl Acetate | 7 |
| Compound (I-5) | 0.4 |
| Oil-Soluble Dye (Oil Black HBB) | 0.5 |
| Metallic Soap (nickel stearate) | 0.05 |

The above components were homogeneously mixed to obtain an ink composition having a specific resistance of $10^7$ Ω·cm and a viscosity of 4 cp. This composition, when charged in an ink jet recording device, gave a satisfactory image, which could be read out by a reading device using a semiconductor laser beam (780 nm) as a light source.

EXAMPLE 5

| | |
|---|---|
| Compound (I-32) | 0.9 g |
| Nitrocellulose | 0.6 g |
| Dichloromethane | 7 ml |

A solution having the above composition was caoted on a glass plate by a rotational method and dried at 40° C. to obtain a recording layer having a thickness of 0.40 μm. The reflectance and percent absorption of the resulting recording layer at a wavelength of 780 nm were 12% and 30%, respectively.

Signals were recorded on the resulting recording medium at 1 MHz with a semiconductor laser beam having a wavelength of 780 nm and a beam diameter of 1.6 μm at an energy quantity of 4 mW on the irradiated surface. As a result, a pit of 1.1 μm in diameter was formed by irradiation for 0.4 μsec (1.6 nJ/pit). When the recording medium was preserved at 60° C. and 90% RH under room light for 1 month, no change in recording and readout characteristics was observed.

EXAMPLE 6

| | |
|---|---|
| Compound (I-8) | 0.8 g |
| Polycarbonate Resin | 1.0 g |
| C.I. Acid Blue 83 (C.I. 42630) | 1.2 g |
| 1,2-Dichloroethane | 12 ml |

A solution having the above composition was coated on an acrylic sheet with its surface hardened by a rotational coating method, followed by drying at 60° C. to obtain a recording layer having a thickness of 0.4 μm. The reflectance and percent absorption of the recording layer at a wavelength of 800 nm were 12% and 22%, respectively, and those at a wavelength of 630 nm were 11% and 58%, respectively. Signals were recorded on the resulting recording medium with a semiconductor laser beam having a wavelength of 800 nm and a beam diameter of 1.6 μm at an energy quantity of 6 mW at the irradiated surface and at a frequency of 0.4 MHz. As a result, a pit of 1.0 μm in diameter was formed by irradiation for 1.0 μsec (6.0 nJ/pit). When signals of 4 MHz were recorded on the above recording medium with an He-Ne laser beam having a beam diameter of 1.6 μm at an energy quantity of 5 mW at the irradiated surface, a pit of 1.0 μm in diameter was formed by irradiation for 0.4 μsec (1.6 nJ/pit).

The same preservation test as in Example 5 was carried out, but no change in characteristics was observed.

EXAMPLE 7

| | |
|---|---|
| Compound (I-5) | 0.9 g |
| Nitrocellulose | 0.7 g |
| Dichloromethane | 20 ml |

A coating composition having the above composition was coated on a glass plate by a rotational coating method and dried at 40° C. to form a recording layer having a thickness of 0.40 μm. The reflectance and percent absorption of the recording layer at a wavelength of 780 nm were 16% and 60%, respectively.

Signals of 1 MHz were recorded on the resulting recording medium with a semiconductor laser beam having a wavelength of 780 nm and a beam diameter of 1.6 μm at an energy quantity of 4 mW at the irradiated surface. As a result, a pit of 1.0 μm in diameter was formed by iradiation of 0.3 μsec (1.2 nJ/pit). When the recording medium was preserved at 60° C. and 90% RH under room light for 1 month, no change in recording and readout characteristics was observed.

EXAMPLE 8

| | |
|---|---|
| Compound (I-5) | 0.9 g |
| Polycarbonate Resin | 0.7 g |
| C.I. Acid Blue 83 (C.I. 42630) | 1.2 g |
| 1,2-Dichloroethane | 12 ml |

A solution having the above composition was rotation-coated on an acrylic sheet with its surface hardened, followed by drying at 60° C. to obtain a recording layer having a thickness of 0.4 μm. The reflectance and percent absorption of the recording layer at a wavelength of 780 nm were 14% and 59%, respectively, and those at a wavelength of 630 nm were 13% and 60%, respectively. When signals of 0.4 MHz were recorded on the resulting recording medium with a semiconductor laser beam having a wavelength of 780 nm and a beam diameter of 1.6 μm at an energy quantity of 6 mW, a pit of 1.0 μm in diameter was formed by irradiation of 0.3 μsec (1.8 nJ/pit). Further, when signals of 4 MHz were recorded on the above recording medium with an He-Ne laser beam having a beam diameter of 1.6 μm at an energy quantity of 5 mW, a pit of 1.0 μm in diameter was formed by irradiation for 0.4 μsec (1.6 nJ/pit).

When subjected to the same preservation test as in Example 7, no change in characteristics was observed.

EXAMPLE 9

| Solution A: | |
|---|---|
| Cellulose Acetate Butyrate | 0.8 g |
| Acetone | 32 ml |

| Solution B: | |
|---|---|
| Compound (I-5) | 0.9 g |
| Polyvinyl Formal | 0.7 g |
| Dichloromethane | 10 g |

Solution A was rotation-coated on a polycarbonate disc and dried to form an undercoat having a dry thickness of 0.1 μm. Solution B was then rotation-coated thereon, followed by drying to form a recording layer having a dry thickness of 0.4 μm. Silver was vacuum-evaporated onto the recording layer to a deposit thickness of 0.1 μm to obtain a recording medium having a mirror surface. A pair of the resulting recording media were superimposed in such a manner that the mirror surfaces faced each other with spacers being interposed therebetween at the center and the periphery of the disc to thereby obtain a recording medium in which two recording discs were sandwiched.

A semiconductor laser beam having a wavelength of 780 nm and a beam diameter of 1.6 μm was irradiated onto the recording medium from the side of the polycarbonate support at an energy quantity of 6 mW at the irradiated surface, whereby a pit of 0.9 μm in diameter was formed by irradiation for 0.7 μsec (4.2 nJ/pit).

When the resulting recording medium was preserved at 80° C. and 90% RH under room light for 2 months, it did not suffer from substantial deterioration in recording and readout characteristics.

EXAMPLE 10

| | |
|---|---|
| Compound (I-5) | 0.9 g |
| Polyvinyl Formal | 0.7 g |
| Dichloromethane | 12 ml |

A solution having the above composition was rotation-coated on a polycarbonate resin plate on which aluminum had been vacuum-evaporated to a thickness of 0.08 μm to obtain a light-absorbing layer having a dry thickness of 0.6 μm. The reflectance and percent absorption of the recording layer at a wavelength of 780 nm were 15% and 65%, respectively. Signals of 2 MHz were recorded on the recording medium with a semiconductor laser beam having a wavelength of 780 nm and a beam diameter of 1.6 μm at an energy quantity of 6 mW at the irradiated surface from the base side. As a result, a pit of 0.9 μm in diameter was formed by irradiation for 0.5 μsec (3.0 nJ/pit). Even after preservation of the recording medium at 60° C. and 90% RH for 1 month, there was observed no deterioration in recording and readout characteristics.

EXAMPLE 11

| | |
|---|---|
| Nitrocellulose | 0.4 g |
| Dichloromethane | 10 ml |

A solution of the above composition was rotation-coated on an acrylic plate to form an undercoat. Compound (I-5) was then vacuum-evaporated onto the undercoat to obtain a recording layer having a thickness of 0.2 μm. Further, a solution of 0.5 g of gelatin in 10 ml of water was rotation-coated thereon to form a protective layer having a thickness of 0.5 μm. A laser beam having a wavelength of 780 nm was irradiated on the resulting recording medium from the base side in the same manner as in Example 7 to form a pit of 0.9 μm in diameter by irradiation for 0.5 μsec (2.0 nJ/pit). When the thus recorded medium was preserved at 60° C. and 90% RH under room light for 1 month, no change in characteristics was observed.

EXAMPLE 12

In 25 parts of diisopropylnaphthalene were dissolved 2.4 parts of 2-anilino-3-methyl-6-N-cyclohexyl-N-methylaminofluoran and 2.4 parts of 2-anilino-3-chloro-6-diethylaminofluoran as color forming leuco dyes and 0.3 part of Compound (I-11) to prepare a solution as a core material. To the solution were further added 18 parts of a xylylene diisocyanate-trimethylolpropane (3:1) adduct and 17 parts of methylene chloride.

The thus prepared solution of color formers was added to an aqueous solution of 3.5 parts of polyvinyl alcohol, 1.7 parts of gelatin and 2.4 parts of 1,4-di(hydroxyethoxy)benzene in 58 parts of water, followed by emulsifying at a temperature of 20° C. to obtain an emulsion having an average particle size of 3 μm. To the emulsion was added 100 parts of water, and the emulsion was heated to 60° C. while stirring for 2 hours. There was obtained a microcapsule emulsion containing color formers, a coloration inhibitor and an ultraviolet absorbent as core materials.

Separately, 20 parts of bisphenol A as a color developer was added to 100 parts of a 5 wt% aqueous solution of polyvinyl alcohol, and the mixture was dispersed in a sand mill for about 24 hours to obtain a bisphenol A dispersion having an average particle size of 3 μm.

5 Parts of the resulting microcapsule emulsion and 3 parts of the resulting bisphenol A dispersion were mixed to prepare a coating composition. The coating composition was coated on smooth fine paper having a basis weight of 50 g/m$^2$, followed by drying at 40° C. for 30 minutes to form a heat-sensitive recording layer having a dry weight of 7 g/m$^2$.

The thus prepared heat-sensitive recording paper was designated as Sample A.

Sample B was prepared in the same manner as for Sample A except that Compound (I-11) was not added as a core material.

A GII mode heat-sensitive printer (Panafax 200, manufactured by Hitachi, Ltd.) was loaded with each of Samples A and B. When heat-recording was effected on the recording paper with a thermal head, a clear black image was obtained in the heat-sensitive recording paper containing Compound (I-11) (Sample A) as shown below.

| | Sample A | Sample B |
|---|---|---|
| Color Density | 1.23 | 1.09 |
| Fog Density | 0.11 | 0.10 |

EXAMPLE 13

A visible light-transmitting resin composition was prepared by mixing 70 g of hexahydrophthalic acid, 20 g of tetraglycidyl isocyanurate, 30 g of CX-221 (a trade name, produced by Chisso Corp.) and 0.15 g of imidazole and dissolving 0.5 g of Compound (I-5) in the mixture.

A silicone diode was set in a mold heated to about 150° C., and the resin composition was flow-casted on the surface of the diode to a thickness of about 2 mm, followed by curing for 5 minutes. The silicone diode thus covered with the resin layer was taken out from the mold and further subjected to curing at 150° C. for an additional 2 hours thereby to obtain a molded silicone diode for a light sensor of a camera.

EXAMPLE 14

A coating composition comprising Compound (I-5), a thermosetting acrylic resin and dimethylformamide at a weight ratio of 1.3:8:3 was coated on a 0.5 mm thick transparent glass plate to a thickness of 3 μm, followed by curing at 150° C. for 20 minutes to form an infrared shielding layer.

Chromium nitride and then chromium were deposited on the infrared shielding layer by sputtering to a thickness of 500 Å and 1,500 Å, respectively. AZ-1450 Resist (produced by Shipley Inc.) was coated on the chromium deposit layer and then exposed to light through a prescribed photomask. After development and drying, the exposed chromium and chromium nitride layer were removed by etching with an etching solution containing ammonium cerium nitrate. The resist layer was then peeled off to form a photo-shield layer of a prescribed pattern on the infrared shielding layer. The resulting photo-shield layer was free from flares due to internal reflection because the reflectance from the glass surface was 15% or less.

A water-soluble light-sensitive solution comprising casein-ammonium bichromate was coated on the infrared shielding layer having a photo-shield layer to a thickness of 0.8 μm. After drying, a photomask having a prescribed pattern was intimately contacted therewith in exact register. The light-sensitive layer was exposed to light and developed with warm water to form a layer to be dyed in a prescribed pattern. This layer was dyed with a red dye bath to form a colored layer R. After dye fixing, the same procedure as described above was repeated but using a green dye bath to form a colored layer G having a prescribed pattern, followed by the same procedure but using a blue dye bath to form a colored layer B having a prescribed pattern. There was thus obtained a color separation filter layer composed of colored layers R, G and B. Thereafter, acrylic resin was coated on the color separation filter layer to a thickness of 1 μm to form a protective layer. The chip size of the color separation filter corresponded to the size of the light-sensitive area of a solid state image pickup element.

The resulting color separation filter exhibited superior performance of shielding long wavelength light of 700 nm or more.

The red, green and blue dye baths herein used had the following composition:

| Red Dye Bath: | parts |
|---|---|
| Kayanol Milling Red RS (produced by Nippon Kayaku Co., Ltd.) | 1 |
| Acetic Acid | 3 |
| Water | 100 |

| Green Dye Bath: | parts |
|---|---|
| Brilliant Indo Blue (produced by Hoechst) | 1 |
| Suminol Yellow MR (produced by Sumitomo Chemical Co., Ltd.) | 1 |
| Acetic Acid | 3 |
| Water | 100 |

| Blue Dye Bath: | parts |
|---|---|
| Kayanol Cyanine 6 B (produced by Nippon Kayaku Co., Ltd.) | 1 |
| Acetic Acid | 3 |
| Water | 100 |

While the invention has been described in detail and with reference to specific embodiments thereof, it will be apparent to one skilled in the art that various changes and modifications can be made therein without departing from the spirit and scope thereof.

What is claimed is:

1. A near infrared absorbing composition containing at least one compound represented by general formula (I) and having its absorption maxima at wave-lengths of 720 nm or more and at least one compound represented by the general formula (II):

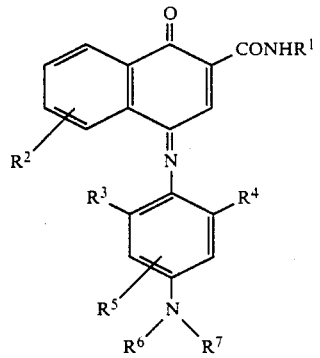

(I)

wherein $R^1$ represents a substituted or unsubstituted alkyl group, a substituted or unsubstituted aryl group or a substituted or unsubstituted heterocyclic group; $R^2$ and $R^5$, which may be the same or different, each represents a hydrogen atom or a group capable of substituting a hydrogen atom; $R^3$ and $R^4$, which may be the same or different, each represents a hydrogen atom, a halogen atom, a substituted or unsubstituted alkoxy group or a substituted or unsubstituted alkyl group with the proviso that they do not simultaneously represent hydrogen atoms; and $R^6$ and $R^7$, which may be the same or different, each represents a substituted or unsubstituted alkyl group, a substituted or unsubstituted aryl group, an acyl group or a sulfonyl group, or $R^6$ and $R^7$ may be taken together to form a 5- or 6-membered ring;

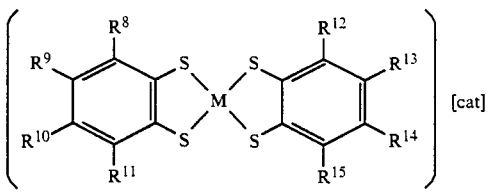

(II)

wherein $R^8$, $R^9$, $R^{10}$, $R^{11}$, $R^{12}$, $R^{13}$, $R^{14}$ and $R^{15}$ each represents a hydrogen atom, a halogen atom or a substituted or unsubstituted alkyl group which is bonded to the benzene ring either directly or via a divalent linking group; M represents nickel, cobalt, copper, palladium or platinum; and "cat" represents a quaternary phosphonium represented by the formula

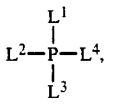

wherein $L^1$, $L^2$, $L^3$ and $L^4$ each represents a substituted or unsubstituted alkyl group having from 1 to 20 carbon atoms or a substituted or unsubstituted aryl group having from 6 to 14 carbon atoms.

2. A near infrared absorbing composition as in claim 1, wherein the alkyl group as represented by $R^1$, $R^6$ or $R^7$ contains from 1 to 18 carbon atoms; the aryl group as represented by $R^1$, $R^6$ or $R^7$ represents a substituted or unsubstituted phenyl group or a substituted or unsubstituted naphthyl group; the alkoxy group as represented by $R^3$ or $R^4$ contains from 1 to 18 carbon atoms; and the alkyl group as represented by $R^3$ or $R^4$ contains from 1 to 18 carbon atoms.

3. A near infrared absorbing composition as in claim 1, wherein the group capable of substituting a hydrogen atom as represented by $R^2$ or $R^5$ represents a halogen atom, a hydroxyl group, a cyano group or a substituted or unsubstituted alkyl group having from 1 to 18 carbon atoms which is bonded to the benzene ring either directly or via a divalent linking group.

4. A near infrared absorbing composition as in claim 1, wherein $R^3$ and $R^4$ each represents a substituted or unsubstituted alkyl group having from 1 to 5 carbon atoms.

5. A near infrared absorbing composition as in claim 1, wherein $R^1$ represents a substituted or unsubstituted heterocyclic group or a phenyl group substituted with a monovalent group having a Hammett's substituent constant $\delta_m$ or $\delta_p$ of not smaller than 0.23.

6. A near infrared absorbing composition as in claim 1, wherein M represents nickel.

7. A near infrared absorbing composition as in claim 1, wherein the added amount of the compound represented by the general formula (II) is from 0.1 to 4.0 parts by weight per 1 part by weight of the compound represented by the general formula (I).

8. A near infrared absorbing composition as in claim 1, wherein said composition further contains a resin.

9. A near infrared absorbing composition as in claim 8, wherein said resin is selected from the group consisting of polyvinyl alcohol, polyvinyl pyrrolidone, polyvinyl butyral, polycarbonate, nitrocellulose, polyvinyl formal, methyl vinyl ether, maleic anhydride copolymers and styrene-butadiene copolymers.

10. A near infrared absorbing composition as in claim 8, wherein the weight ratio of the compound represented by the general formula (I) to the resin is at least 0.01.

* * * * *